US006554258B2

(12) United States Patent
Braswell

(10) Patent No.: US 6,554,258 B2
(45) Date of Patent: Apr. 29, 2003

(54) CARBURETOR FLOAT BOWL

(75) Inventor: David Braswell, Marana, AZ (US)

(73) Assignee: POW Engineering, Inc., Marana, AZ (US)

( * ) Notice: Subject to any disclaimer, the term of this patent is extended or adjusted under 35 U.S.C. 154(b) by 0 days.

(21) Appl. No.: 09/887,984

(22) Filed: Jun. 21, 2001

(65) Prior Publication Data

US 2001/0054773 A1 Dec. 27, 2001

Related U.S. Application Data

(60) Provisional application No. 60/213,390, filed on Jun. 23, 2000.

(51) Int. Cl.[7] ..... F02M 5/16
(52) U.S. Cl. ..... 261/70; 261/72.1; 261/DIG. 50
(58) Field of Search ..... 261/70, 72.1, DIG. 50

(56) References Cited

U.S. PATENT DOCUMENTS 1,577,802 A * 3/1926 Johnson ..... 261/70
2,168,718 A * 8/1939 Scaife ..... 261/70 X
3,202,173 A * 8/1965 Szwargulski ..... 261/70 X
3,314,665 A * 4/1967 Tutch ..... 261/70 X
3,875,267 A * 4/1975 Seki et al. ..... 261/DIG. 50
4,034,026 A * 7/1977 Miller ..... 261/70 X
5,772,928 A * 6/1998 Holtzman ..... 261/70 X
6,364,291 B1 * 4/2002 Grant ..... 261/72.1 X

FOREIGN PATENT DOCUMENTS

JP 57-16243 * 1/1982 ..... 261/70

OTHER PUBLICATIONS

7 Holley Carburetor photographs, Numbered 1 through 7, undated.

6 BG Carburetor photographs, Numbered 8 through 13, undated.

* cited by examiner

*Primary Examiner*—Richard L. Chiesa
(74) *Attorney, Agent, or Firm*—Birdwell, Janke & Durando, PLC

(57) ABSTRACT

A carburetor float bowl. The float bowl includes a float adapted to be flotationally supported by liquid fuel in the float bowl over a predetermined range of the level of fuel therein. A fuel inlet is adapted to direct fuel along a line toward the floor of the float bowl. The float bowl further includes a "fuel chute" having a ramping surface, a portion of which is intersected by said line at a point thereon. The ramping surface is disposed to provide a ramp angle at the point with respect to the floor that is substantially greater than 90 degrees and substantially less than 180 degrees.

11 Claims, 5 Drawing Sheets

CARBURETOR FLOAT BOWL

This application claims the benefit of the inventor's provisional application, Ser. No. 60/213,390, filed Jun. 23, 2000, the entirety of which is incorporated by reference herein.

TECHNICAL FIELD

The invention relates generally to carburetors for internal combustion engines, and more particularly to float bowls therefor.

BACKGROUND OF THE INVENTION

Despite the ubiquitous use of fuel injection, carburetors remain in use in many internal combustion engines, especially racing engines.

High performance carburetors are used in racing engines and high-performance street engines. Such carburetors commonly employ so-called "modular" construction, wherein a main body, typically including two or four venturis, is bolted to a throttle plate or body, which includes butterfly valves operated by a throttle. A metering plate or block containing the jets is bolted to the side of the main body so as to form a back or interior side of the float bowl. The float bowl itself has five sides and bolts to the metering block to form, with the metering plate, an enclosure for liquid fuel. These parts are all shown and described in the publication "Holley Tech" by Alex and Nancy Walordy, of Westbury, N.Y. (ISBN #0-941167-04-6), herein incorporated by reference in its entirety. The float bowl receives liquid fuel pumped to a fuel inlet of the carburetor, and releases the fuel through a jet which atomizes the fuel into a venturi of the carburetor.

Modular construction is contrasted with unitary construction wherein the aforementioned parts or their equivalents are die cast in one piece. Unitary construction imposes some limitations on the configuration of the carburetor, and does not permit removing and replacing the particular parts and thereby customizing or adjusting the carburetor for particular performance requirements, or effecting quick repair.

Fuel passes through an inlet having a seat for a needle that is coupled to a float. As the fuel level in the float bowl rises, the float also rises, forcing the needle against the seat and ultimately stopping the flow of fuel when a predetermined fuel level is reached.

A problem with the operation of the float bowl is that the fuel "sloshes" in the float bowl with acceleration or deceleration of the vehicle in which the carburetor is mounted. It is well appreciated in the art that this sloshing may "starve" the jets and prevent fuel from reaching the venturis. However, it is not generally recognized, as it has been by the present inventor, that this sloshing contributes to turbulence, aeration and eddies in the flowing fuel which hampers performance even if the jets are not starved. Further, the present inventor has recognized that turbulence, aeration and eddy currents may be induced in the fuel even if the vehicle in which the carburetor is mounted is not accelerating or decelerating, but may result merely from the flow of the fuel.

Accordingly, there is a need for a carburetor float bowl that minimizes or prevents turbulence, aeration and eddy currents in fuel passing from the carburetor float bowl to the venturis of the carburetor, both as a result of acceleration and deceleration and as a result of fuel flow.

SUMMARY OF THE INVENTION

The carburetor float bowl of the present invention solves the aforementioned problems and meets the aforementioned need by providing a carburetor float bowl having a floor and at least one side adjacent and connected to the floor. The float bowl includes a float adapted to be flotationally supported by liquid fuel in the float bowl over a predetermined range of the level of fuel therein. A fuel inlet is adapted to receive fuel under pressure, the fuel inlet comprising a valve including a valve closing element coupled to said float and adapted to substantially stop the flow of fuel when said float rises to a predetermined maximum level of the range. The fuel inlet is adapted to direct fuel along a line toward the floor of the float bowl. The float bowl further includes a "fuel chute" having a ramping surface, a portion of which is intersected by said line at a point thereon. The ramping surface is disposed to provide a ramp angle at said point with respect to the floor that is substantially greater than 90 degrees and substantially less than 180 degrees, preferably about 120 degrees.

In one aspect of the invention, the ramping surface has an end terminating substantially at the floor. In another aspect of the invention, the ramping surface terminates in a radiused portion that is substantially tangent to the ramping surface at one end and substantially tangent to said floor at the other end. Preferably, the ramping surface terminates substantially at the floor with the radiused portion.

Therefore, it is a principal object of the present invention to provide a novel and improved carburetor float bowl.

It is another object of the present invention to provide a carburetor float bowl that provides for minimizing or preventing turbulence in fuel passing from the carburetor float bowl to the venturis of the carburetor.

It is yet another object of the present invention to provide a carburetor float bowl that provides for minimizing or preventing aeration in fuel passing from the carburetor float bowl to the venturis of the carburetor.

It is still another object of the present invention to provide a carburetor float bowl that provides for minimizing or preventing eddy currents in fuel passing from the carburetor float bowl to the venturis of the carburetor.

It is a further object of the present invention to provide a carburetor float bowl that provides for minimizing or preventing turbulence, aeration or eddy currents in fuel passing from the carburetor float bowl to the venturis of the carburetor while the vehicle in which the carburetor is mounted is accelerating or decelerating.

It is yet a further object of the present invention to provide a carburetor float bowl that provides for minimizing or preventing turbulence, aeration or eddy currents in fuel passing from the carburetor float bowl to the venturis of the carburetor as a result of fuel flow.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
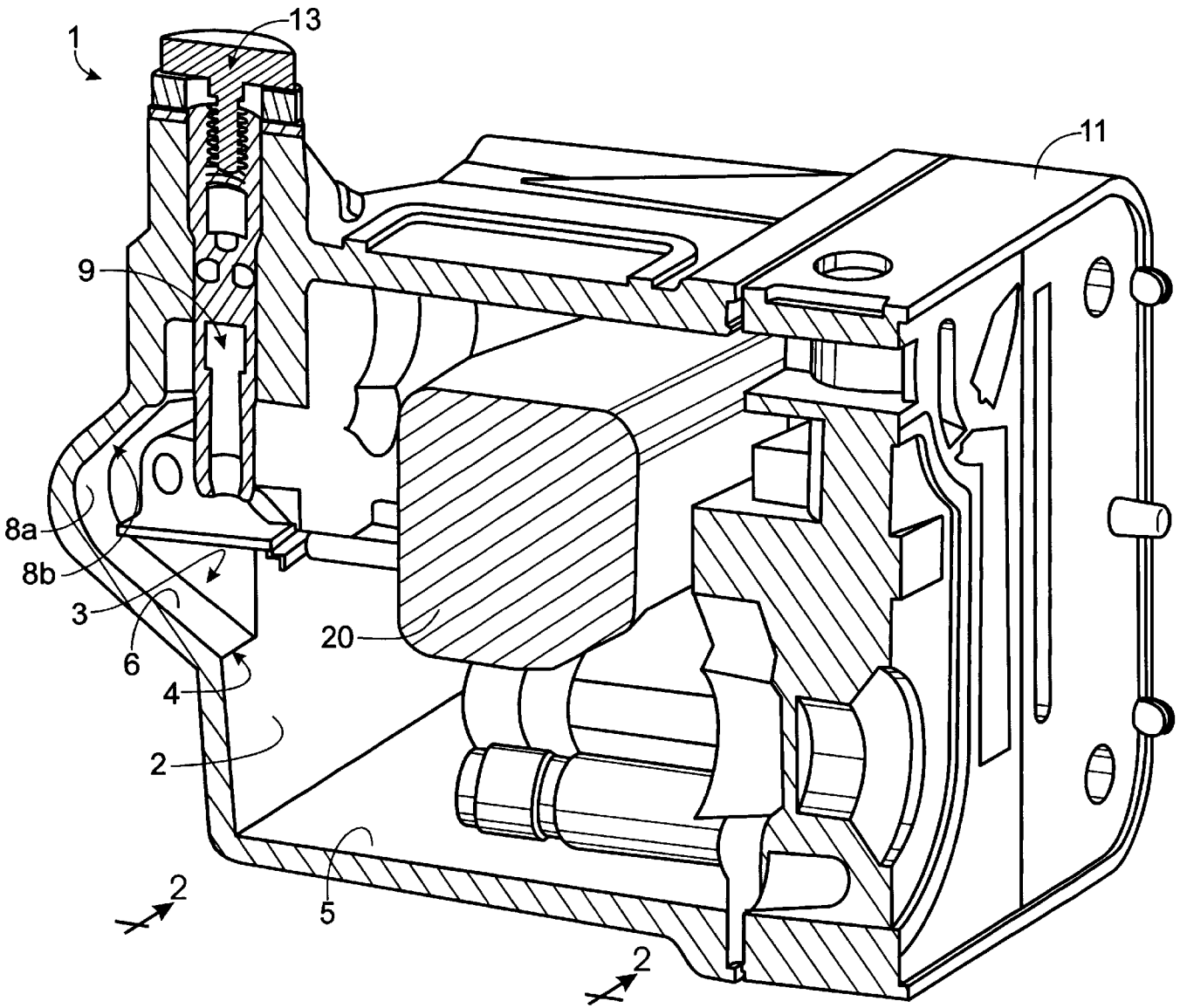
Fig. 1 (PRIOR ART)
FIG. 1 is a cut-away pictorial view of a prior art carburetor float bowl.
Figure 2:
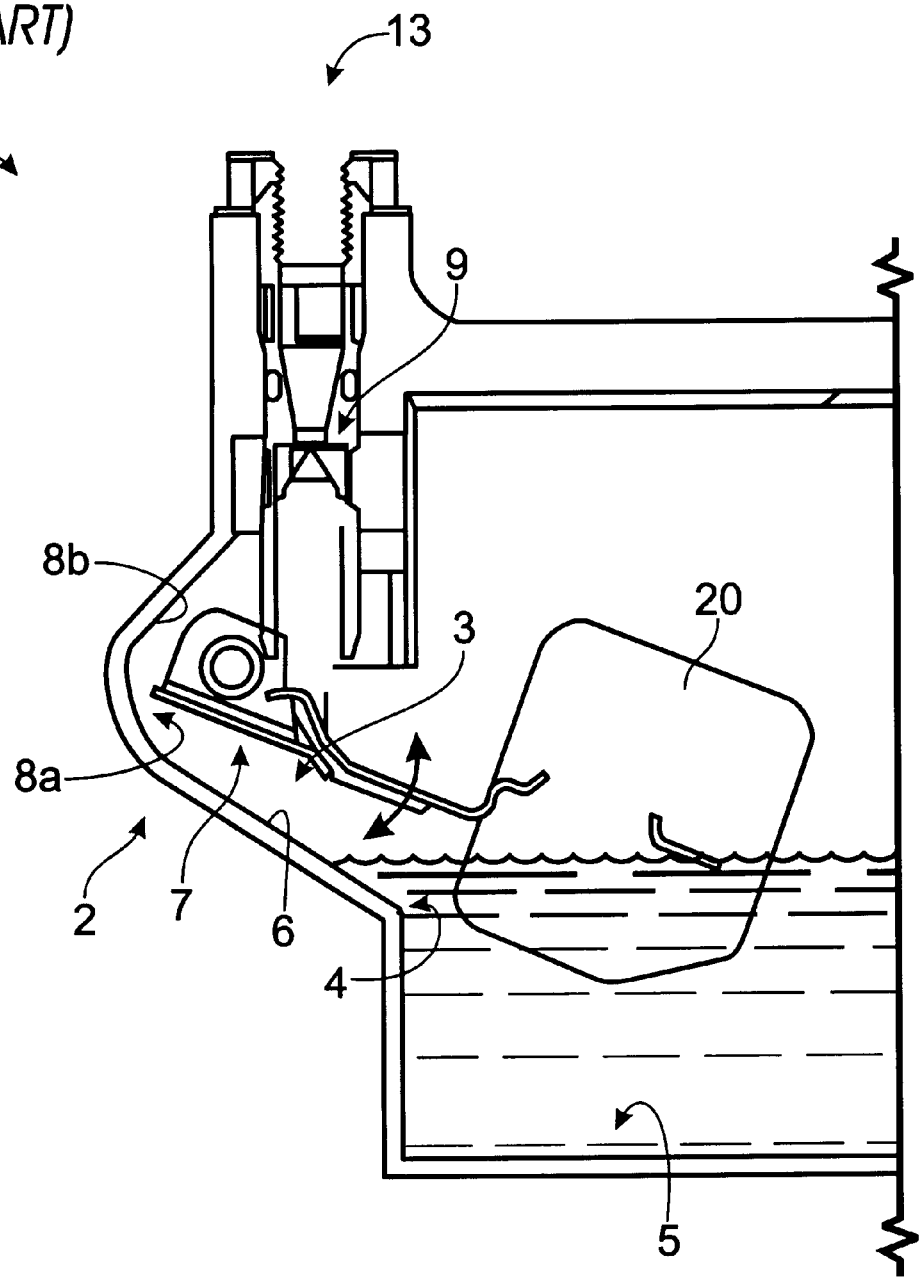
Fig. 2 (PRIOR ART)
FIG. 2 is a side elevation of the prior art float bowl of FIG. 1, taken along a line 2—2 thereof.
Figure 3:
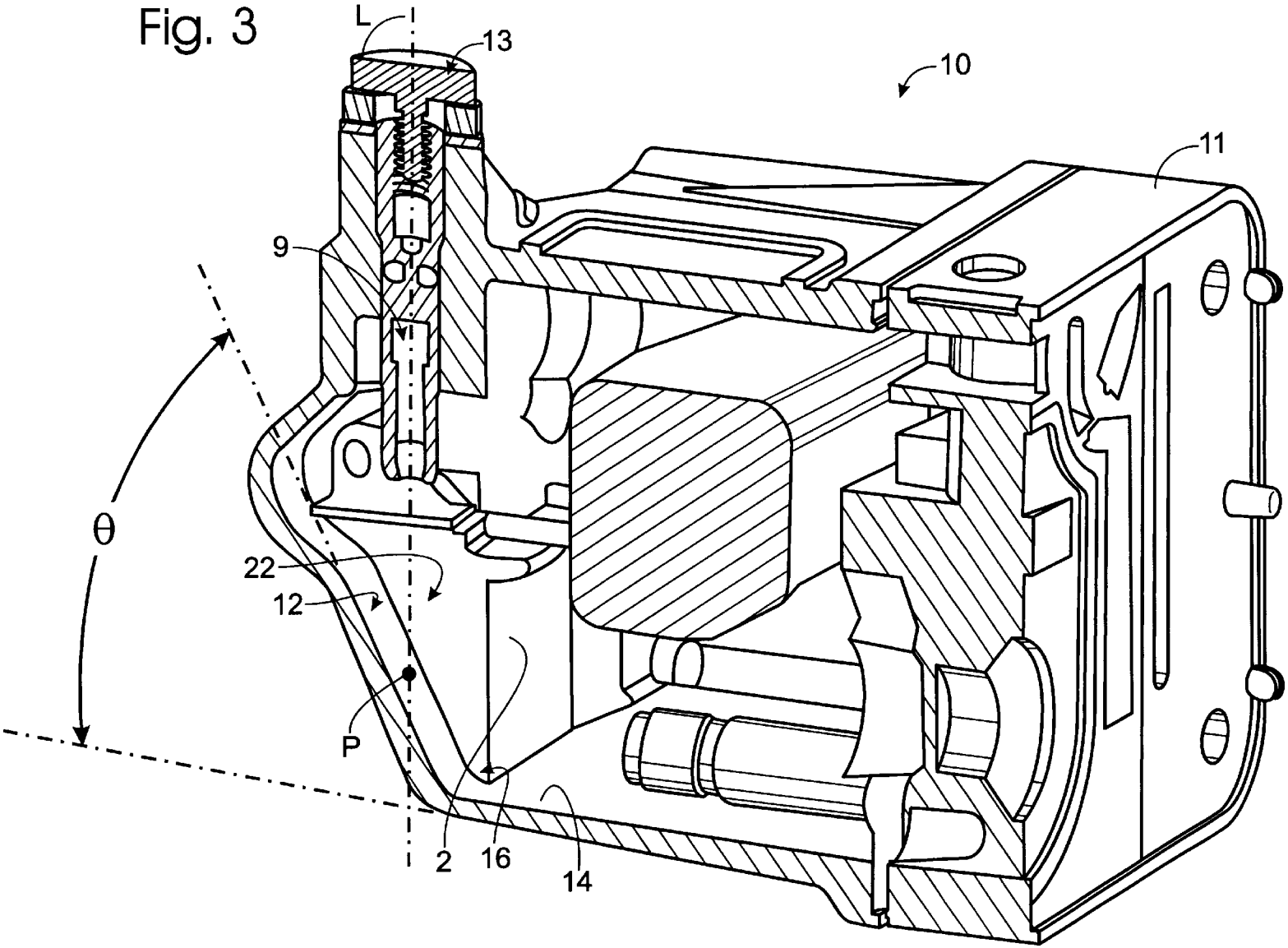
FIG. 3 is a cut-away pictorial view of a carburetor float bowl according to the present invention.

FIGS. 1 and 3 reproduce drawings provided in the inventor's provisional patent application. FIGS. 1 and 2 show a prior art modular carburetor float bowl 1. A float 20 is attached to the interior of the float bowl by a hinge assembly 7 (FIG. 2) which permits the float to pivot upwardly and downwardly. The hinge assembly is not shown in FIG. 1 for clarity; however it is mounted to a front wall 2 of the float bowl and extends into a depression 3 shaped and provided for receiving the hinge at a minimum float level as shown in FIG. 2. A metering block 11 is shown attached to the float bowl (FIG. 1), completing an enclosure for containing the fuel.

One end of the depression begins at a sharp edge 4 which is situated about 0.5" above the floor 5 of the float bowl, the depression having a substantially planar ramping surface 6 ramping forwardly and upwardly and merging with a radiused end 8*a* into another ramping surface 8*b* ramping backwardly and upwardly, toward the a fuel inlet 13 having a location 9 wherein resides the needle and seat. Fuel flows into the inlet 13 downwardly through the location 9, past the depression 3, filling the bowl to a predetermined level that is controlled by the float.

Turning to FIG. 3, a carburetor float bowl 10 according to the present invention is shown. As for the prior art float bowl, the metering block 11 is shown attached thereto. Fuel flows from the inlet 13 and location 9 downwardly along a line "L" toward a floor 14. However, in a preferred embodiment of the invention, the front wall 2 of the float bowl is relieved to form a "fuel chute" 22 providing outstanding advantages. The fuel chute 22 bears some superficial similarities to the depression 3 of the prior art; however, the fuel chute 22 is not provided merely to accommodate the range of motion of a hinge assembly for the float. Rather, the fuel chute 22 is particularly shaped and extended to assist and improve fuel flow in the carburetor by reducing turbulence, aeration and eddy currents in fuel flowing into the float bowl. This is an objective not recognized in the prior art and which is not met by the depression 3.

The fuel chute has a ramping surface 12 that is angled with respect to the floor 14 and is intersected by the line "L" along which the fuel flows. The angle $\Theta$ (180°-$\theta$) of the ramping surface at the point of intersection "P" is substantially more than 90 degrees but substantially less than 180 degrees. As an example, the ramping surface 12 is preferably planar as shown, having an angle $\Theta$ at the point "P" (as well as elsewhere over the surface 12) that is about 120 degrees with respect to the floor. The fuel is directed against the ramping surface and is redirected gently toward the floor. It is believed that even when the float bowl is full of fuel, this action reduces turbulence, aeration and eddy currents to an extent sufficient to improve performance in racing applications.

A particular advantage is achieved by extending the ramping surface all the way to the floor 14, which eliminates any abrupt discontinuity over which the fuel falls unguided or undirected.

A further advantage is achieved by providing that one end of the ramping surface 12 smoothly joins the surface of the floor 14 of the float bowl with a radiused, concave portion 16 rather than with a sharp edge. The radius of the portion 16 is preferably at least about 0.100"; however, any substantially non-zero radius provides an advantage over the prior art.

Figure 4:
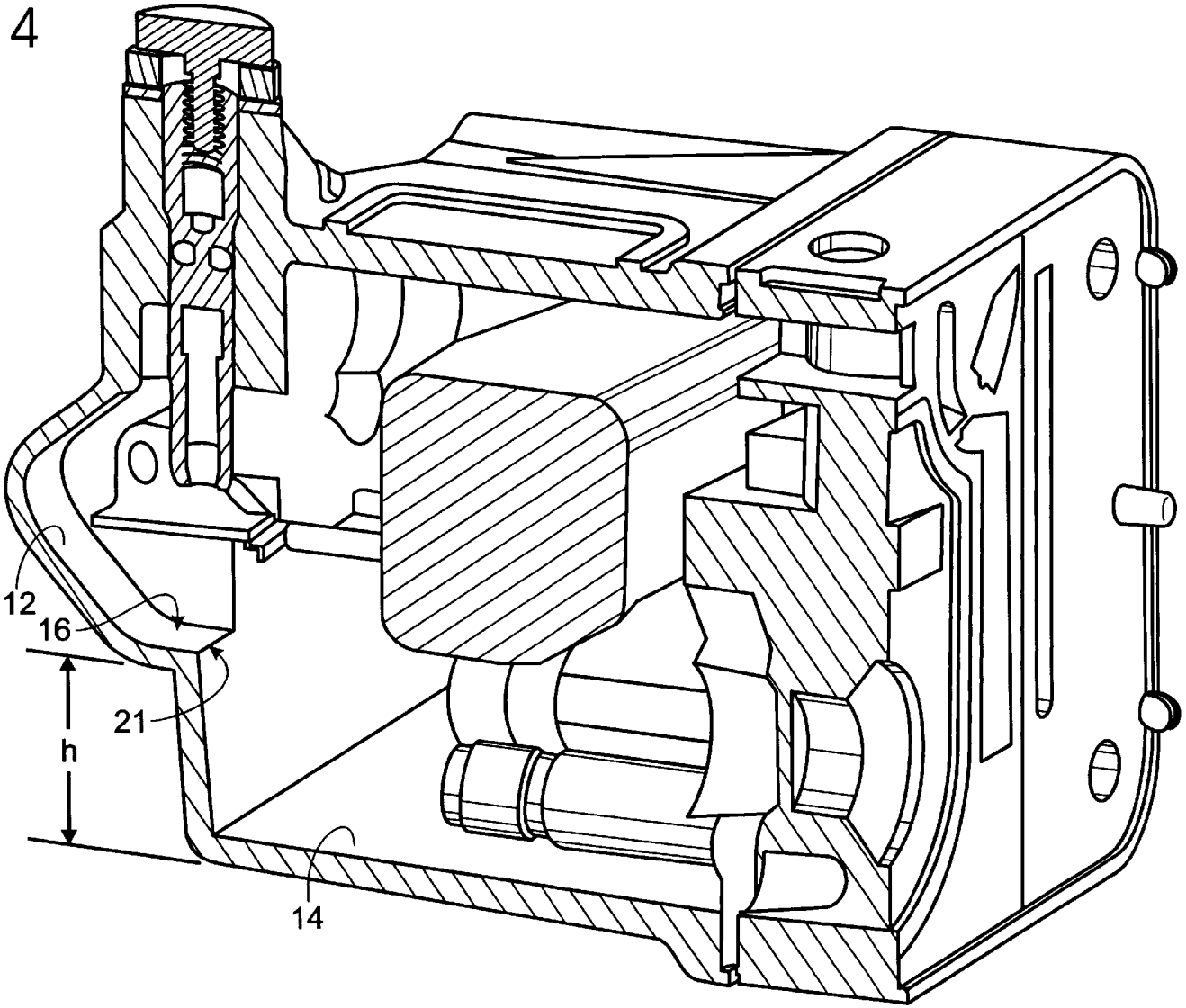
FIG. 4 is a cut-away pictorial view of another carburetor float bowl according to the present invention.

Referring to FIG. 4, the ramping surface 12 may terminate above the floor 14 in a sharp edge 21 and still provide an improvement in fuel flow over the prior art, because of the radiused end 16 of the chute. Preferably, however, the height "h" is minimized and is at most about 0.25"; however, it may be higher and as the height is increased, it is beneficial to increase the radius as well.

While the fuel chute 22 (FIG. 3 and FIG. 6 below) is advantageously formed as part of the side-wall 2 as shown, it may be provided independently thereof, or be attached thereto, without departing from the principles of the invention.

Figure 5:
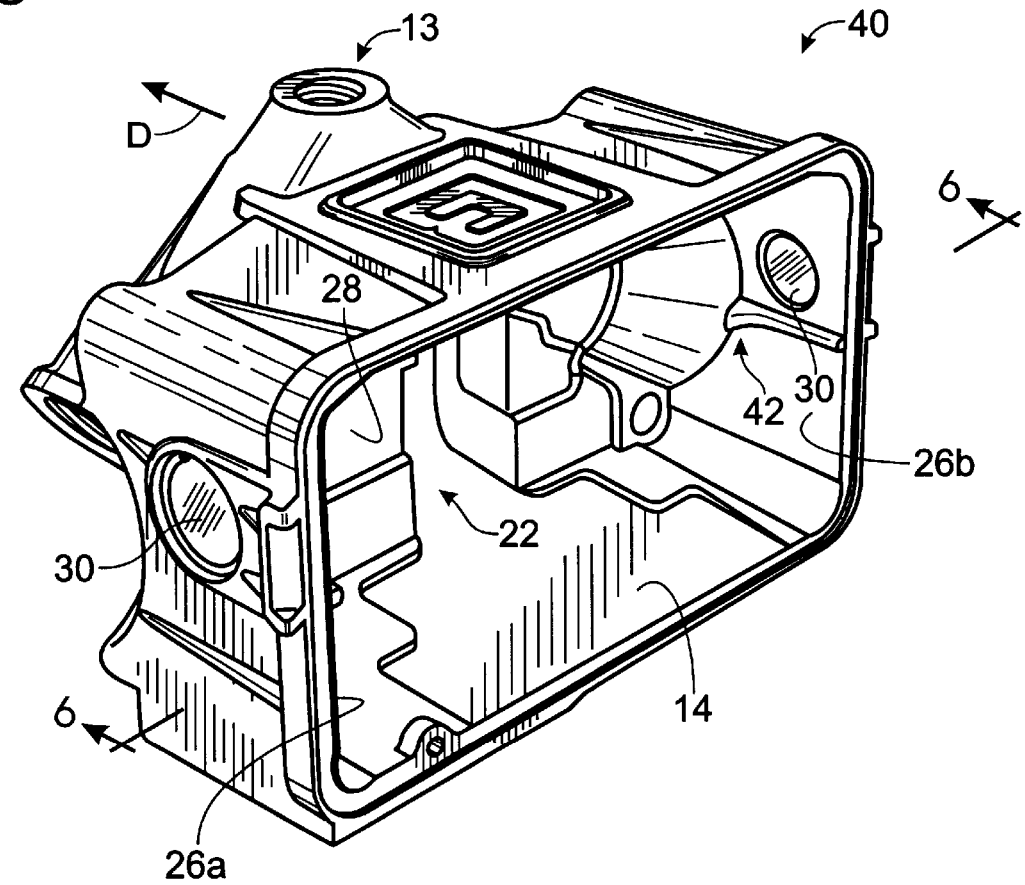
FIG. 5 is a pictorial view of a carburetor float bowl according to the present invention, showing some internal features.
Figure 6:
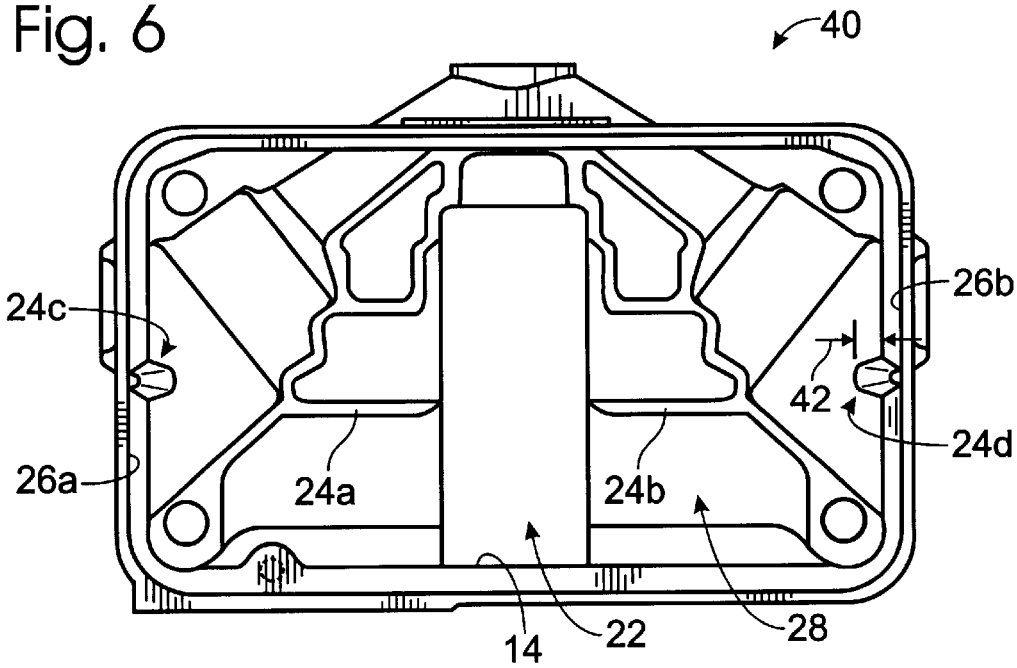
FIG. 6 is a rear elevation of the carburetor float bowl of FIG. 4, taken along a line 6—6 thereof.

FIG. 5 shows a perspective view of a carburetor float bowl 40 according to the present invention to illustrate another aspect thereof The metering plate 11 is omitted from the Figure so that internal surfaces can be seen. FIG. 6 is a rear elevation of the same float bowl. According to the invention, the float bowl 40 preferably includes ridges 24 protruding from the inside surfaces of one or more of the walls thereof, preferably at a height that is less than the maximum float level, which is defined approximately by the horizontal center-line of glass covered sight-apertures 30. The ridges preferably extend from the walls, e.g., at 42, about 0.075" to about 0.250"; however, the ridges may provide even greater benefits by extending further, the limitation on the amount of extension being the point of interference with other internal parts of the float bowl, such as the float.

Shown in FIGS. 4 and 5 are two side-walls 26*a*, 26*b* and a front wall 28 including the fuel chute 22. Preferably two distinct ridges 24*a* and 24*b* are associated with the front wall 28 on either side of the fuel chute 22, and two distinct ridges 24*c* and 24*d* are associated respectively with the side-walls 26*a* and 26*b*. The ridges are preferably integrally formed with the walls; however, they may be provided independently thereof, or be attached thereto, without departing from the principles of the invention.

With the float bowl attached to a carburetor mounted to an engine that is installed in its typical orientation in a vehicle, i.e., so that the exterior surface of the front wall 28 faces forwardly in the direction of travel "D" of the vehicle, ridges 24*a*, 24*b* associated with the front wall 28 resist sloshing in the fore/aft direction, e.g., when the vehicle is accelerating or decelerating straight ahead. The ridges 24*c*, 24*d*, associated with the side-walls 26*a*, 26*b* respectively, resist sloshing when the vehicle is cornering. Moreover, all of the ridges resist sloshing as a result of fuel flow even when the vehicle is not accelerating or decelerating.

While the fuel chute and the ridges will each independently provide an advantage in reducing turbulence, aeration and eddy currents in the float bowl, the combination of features is believed to produce benefits unexpected from considering their independent contributions.

It is to be recognized that, while a particular carburetor float bowl has been shown and described as preferred, other configurations and methods could be utilized, in addition to those already mentioned, without departing from the principles of the invention. It should be noted that, although a number of improvements have been shown, it is not essential to include or employ all of the features provided by the present invention together to realize at least some of its advantages.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. A carburetor float bowl having a floor and adapted for containing liquid fuel, comprising:

a float adapted for flotation in the fuel in the float bowl over a predetermined range of the level of the fuel;

a fuel inlet adapted to receive the fuel under pressure, said fuel inlet comprising a valve including a valve closing element coupled to said float and adapted to substantially stop the flow of fuel when said float rises to a predetermined maximum level of said range, said fuel inlet adapted to direct fuel along a line toward the floor of the float bowl; and a fuel chute having a substantially flat ramping surface, a portion of which is intersected by said line at a point thereon, said ramping surface providing a ramp angle at said point with respect to the floor that is substantially greater than 90 degrees and substantially less than 180 degrees, wherein said ramping surface has an end terminating substantially at the floor.

2. The carburetor float bowl of claim 1, wherein said ramping surface terminates in a radiused portion that is tangent to said ramping surface at one end and tangent to said floor at the other end.

3. The carburetor float bowl of claim 2, wherein said ramping surface is substantially planar.

4. The carburetor float bowl of claim 1, wherein said ramping surface is formed into an inside surface of a front wall of the carburetor that joins said floor, the carburetor further comprising ridges extending from said inside surface of said front wall beneath said maximum level of said range.

5. The carburetor float bowl of claim 4, further comprising two side-walls that join said floor at respective ends thereof and said front wall, and ridges extending from respective inside surfaces of said side-walls beneath said maximum level of said range.

6. The carburetor float bowl of claim 4, wherein said ramping surface is substantially planar.

7. The carburetor float bowl of claim 1, further comprising two side-walls that join said floor at respective ends thereof, and ridges extending from respective inside surfaces of said side-walls beneath said maximum level of said range.

8. A carburetor float bowl having a floor and adapted for containing liquid fuel, comprising:

a float adapted for flotation in liquid fuel in the float bowl over a predetermined range of the level of fuel;

a fuel inlet adapted to receive the fuel under pressure, said fuel inlet comprising a valve including a valve closing element coupled to said float and adapted to substantially stop the flow of fuel when said float rises to a predetermined maximum level of said range, said fuel inlet adapted to direct fuel along a line toward the floor of the float bowl; and a fuel chute having a ramping surface, a portion of which is intersected by said line at a point thereon, said ramping surface having a ramp angle at said point with respect to the floor that is substantially greater than 90 degrees and substantially less than 180 degrees, said ramping surface having a radiused portion terminating above said floor, wherein said radiused portion has a proximal end sloping at an angle that is tangent to said ramp angle and a distal end sloping at an angle that is substantially parallel to said floor.

9. The carburetor float bowl of claim 8, wherein said ramping surface is formed into an inside surface of a front wall of the carburetor that joins said floor, the carburetor further comprising ridges extending from said inside surface of said front wall beneath said maximum level of said range.

10. The carburetor float bowl of claim 9, further comprising two side-walls that join said floor at respective ends thereof and said front wall, and ridges extending from respective inside surfaces of said side-walls beneath said maximum level of said range.

11. The carburetor float bowl of claim 8, further comprising two side-walls that join said floor at respective ends thereof, and ridges extending from respective inside surfaces of said side-walls beneath said maximum level of said range.

* * * * *